United States Patent [19]

Green

[11] Patent Number: 4,911,607

[45] Date of Patent: Mar. 27, 1990

[54] LIFT TRUCK FORK

[75] Inventor: Alan E. Green, Guelph, Canada

[73] Assignee: Kenhar Products Incorporated, Guelph, Canada

[21] Appl. No.: 282,776

[22] Filed: Dec. 12, 1988

Related U.S. Application Data

[63] Continuation of Ser. No. 897,897, Aug. 19, 1986, abandoned.

[51] Int. Cl.[4] ..... B66F 9/14

[52] U.S. Cl. ..... 414/785

[58] Field of Search ..... 414/785

[56] References Cited

U.S. PATENT DOCUMENTS 3,982,647 9/1976 Teutsch ..... 414/785

4,061,238 12/1977 Cunningham et al. ..... 414/785 X

FOREIGN PATENT DOCUMENTS 2246937 4/1974 Fed. Rep. of Germany ..... 414/785

3318388 11/1984 Fed. Rep. of Germany ..... 414/785

3336310 4/1985 Fed. Rep. of Germany ..... 414/785

2150112 6/1985 United Kingdom ..... 414/785

*Primary Examiner*—David A. Bucci

*Attorney, Agent, or Firm*—Rogers, Bereskin & Parr

[57] ABSTRACT

In vehicles for material handling commonly known as lift trucks, it is known to have forks for lifting and supporting the material being handled. In this invention, the curved portion of the fork, known as the "heel" is modified to reduce the stresses which arise in this area when the fork is loaded. The modifications include thickening of the heel during forming by approximately 5% toward the blade and approximately 2.5% toward the shank, enlarging the inside radius of the heel by machining and providing a clearance cavity in the top surface of the region where the blade meets the heel. Also disclosed is a process for manufacturing lift truck forks comprising bending, then upset using a backing die of proper configuration to form a thickened portion of the heel which tapers into the lower portion of the blade, followed by restriking with a die suitably shaped to form an appropriate inside radius and clearance cavity in the heel, heat treatment and final machining to remove surface anomalies and give the desired configuration to the inside radius.

6 Claims, 3 Drawing Sheets

LIFT TRUCK FORK

This is a continuation, of application Ser. No. 897,897 filed on Aug. 19, 1986, now abandoned.

This invention relates to forks for material handling vehicles commonly known as lift trucks.

Those familiar with the design of such forks are cognizant of the requirement to ensure adequate strength to meet the stresses in the heel portion of the fork. The heel of a fork when under load experiences tensile stress at the inner radius and compressive stress at the outer radius. These stresses are generated by the effect of the load placed upon the blade of the fork. The load causes a moment about the shank of the fork which moment is resisted at the heel.

It is desirable in all cases to reduce the tensile stress present at the inside radius of the fork as this is the highest stress portion of the fork. The tensile stress existing at the inside radius is a function of several factors including the size of the inside radius, the ratio of the thickness of the heel to the thickness of the blade, the ratio of the thickness of the heel to the thickness of the shank and the heel thickness itself. It has long been recognized that it is desirable to alter each of the foregoing factors so as to minimize the tensile stresses experienced at the heel. However it has proven difficult to alter all of these factors simultaneously.

There are several traditional methods of manufacturing forks. These include the upset and bend method, forging of the forks and the oldest and simplest method involving simple bending of a straight bar. More recently there has been patented an improved process involving bending followed by an upset process.

In the bend and upset process a straight bar is first bent to form a shank and a blade disposed at approximately 90 degrees to each other. The bend produced in the bending operation is a relatively large radius bend. Following the bending process the fork is fixed by the blade portion and an upset process is applied to the shank portion. The force in the upset process is applied to the shank longitudinally and the fork is forced into a backing die. Following the upset process the fork is struck by a restrike die which forms the final inside radius and determines the final shape of the fork. In this known process it is very difficult to alter the four factors set out above which determine the tensile stresses on the surface of the inside radius.

According to this invention there is disclosed an improved process for manufacturing a fork having a heel which experiences relatively lower tensile stresses. The process involves a bending operation followed by an upset operation. In the upset operation the fork is forced into a backing die which is provided with certain novel features. The backing die comprises a cavity which provides an increase in heel thickness and an increase in the blade heel thickness to blade thickness ratio and also provides, most conveniently, a heel taper. The backing die also permits formation of a clearance cavity by permitting the blade to be deflected slightly during the upset operation. According to the improved process the restrike die is modified and includes additional material. The restrike die is used to finally form the clearance cavity and the inside radius. Simultaneously the final configuration of the heel is set by the forcing of the fork against the backing die by the application of the restrike die. Following the use of the restrike die the fork may be heat treated. Following heat treatment a machining operation is applied to the inside radius to provide the final inside radius. The surface is machined to provide a smooth uniform finish and to provide an accurate final radius. The machining operation provides a circular curve to the inside radius.

Further in accordance with the invention there is provided an improved fork. The improved fork is thickened in the heel region both in the section of the heel adjacent to the shank and in the section of the heel adjacent to the blade. The ratio of the thickening of the heel adjacent to the blade provides a ratio of blade heel thickness to blade thickness of at least 1.04, preferably about 1.05, and more preferably as much as 1.06. The thickening of the heel adjacent to the shank provides a ratio of the shank heel thickness to shank thickness of about 1.02 and preferably about 1.025 or greater. In addition the improved fork has a machined inside radius.

In accordance with a further embodiment of the invention the fork is provided in addition to the above features with a clearance cavity and a heel taper. These and other features of the invention will be more clearly understood from review of the following description and appended drawings which illustrate a preferred embodiment of the invention and in which.

Figure 1:
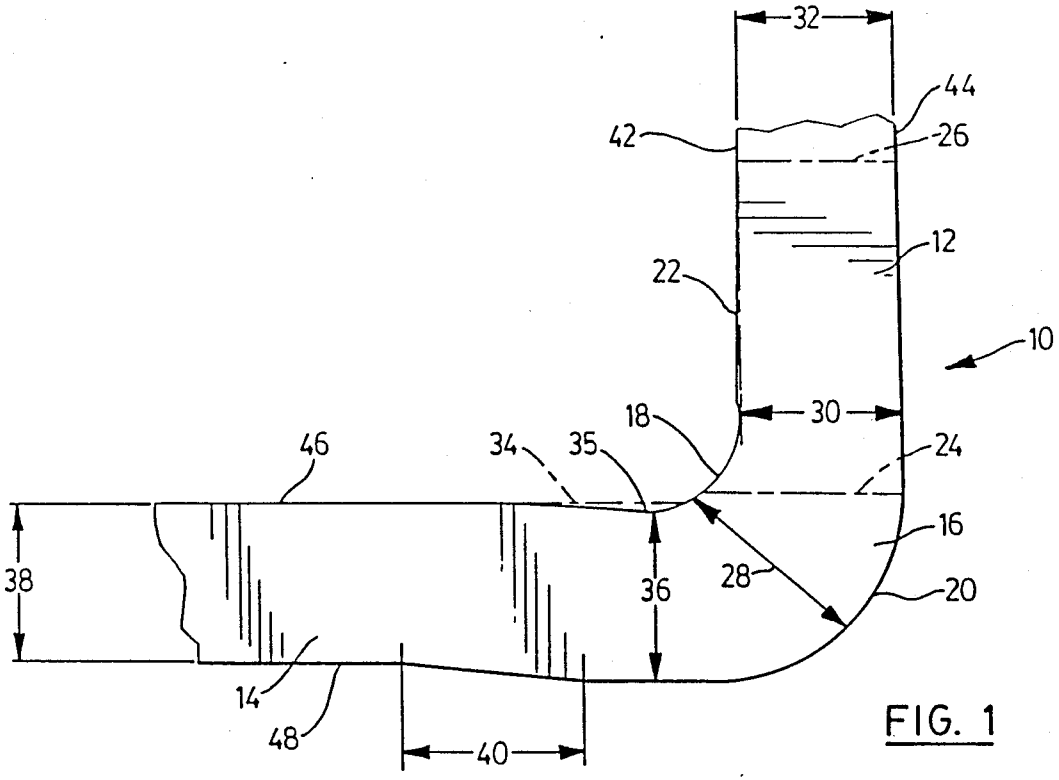
FIG. 1 is a side view of a fork made in accordance with the invention.

In FIG. 1 the fork indicated generally at 10 comprises a shank 12 having inner surface 42 and outer surface 44 and a blade 14 having upper surface 46 and lower surface 48. The heel 16 comprises a central region having an inside radius 18 and an outside radius 20. The fork 10 has an area of stiffening adjacent the shank identified as the region 22 between dotted lines 24 and 26. In addition, there is stiffening of the fork 10 in the area adjacent the blade.

In this disclosure and claims the term heel thickness is used to designate the thickness of the heel measured along the line 28 indicated in FIG. 1. The term shank heel thickness is the minimum distance from the inside radius to the back surface of the fork remote from the blade. This is indicated in the drawing by the line bearing numeral 30. The shank thickness is the original thickness of the shank portion and is indicated in the drawing by the line bearing numeral 32. The term clearance cavity is used to designate the area 35 between the dotted line bearing the numeral 34 and the surface of the fork below the dotted line. The dotted line 34 indicates a continuation of the upper surface of the blade as shown in FIG. 1. The term blade heel thickness is used to refer to the shortest distance measured from the bottom of the clearance cavity to the lowermost surface of the blade. This is illustrated in FIG. 1 by the line bearing numeral 36. The term blade thickness is used to designate the thickness of the blade and is shown in FIG. 1 by the line bearing numeral 38.

From a review of FIG. 1 it will be appreciated that the preferred embodiment illustrated comprises a heel taper designated by the numeral 40 at the lowermost edge of the blade where the transition between the blade and the heel occurs.

Minimization of the tensile stress occurring on the inside radius of the fork is achieved by stiffening in the area of the heel adjacent to both the blade and the shank. In the improved fork shown in FIG. 1 the ratio of the shank heel thickness to the shank thickness is at least 1.02. Preferably the ratio is 1.025. The objective is to increase the shank heel thickness for any given shank thickness thereby reducing the maximum tensile stress.

While there is no upper limit as to the thickening that can occur with the shank heel thickness it is believed that with the traditional bending and upset process it is seldom practical to exceed ratios of shank heel thickness to shank thickness greater than about 1.06.

Similarly the ratio of the blade heel thickness to the blade thickness is approximately 1.05 and desirably is as high as 1.06.

The clearance cavity 35 as shown in FIG. 1 provides several advantageous affects. When a load is placed upon the fork it is, of course, desirable that the load be placed as closely adjacent to the shank as possible thus minimizing the moment arm and therefore the stresses at the heel of the fork. However there is substantial danger if a pallet or other type of load in fact contacts the inside radius of the fork. Such a point loading will provide very substantially increased stresses and may cause premature failure of a fork otherwise capable of carrying the load placed upon the fork.

The fork of this invention may be manufactured according to a process utilizing appropriately modified dies. In a first step of the forming operation the fork is bent to establish a shank and a blade at an included angle of approximately 90 degrees. In the bending operation the radius of curvature will be relatively large. Following the bending operation the fork is supported by the blade remote from the heel. In an upset operation, pressure is applied to the shank in the longitudinal direction forcing the shank against the backing die while the fork is held by the blade. The backing die is provided with a relief in a position suitable to accomodate bending of the fork so as to allow deflection and thereby the creation of a clearance cavity. The heel taper 40 is also formed by the appropriate configuration of the backing die. In the upset operation thickening occurs both in a portion of the heel adjacent to the shank and in the portion of the heel adjacent to the blade. Following the upset operation the fork is struck by a restrike die which contacts the fork at the area of the inside radius. The restrike die forms the substantially final configuration of the inside radius and is utilized while the fork is supported in the backing die. The striking of the fork with the restrike die thus completes formation of the outside radius of the heel as well as giving substantially final formation to the inside radius of the heel.

After upsetting and striking, the fork, in most cases, will be heat treated. Following heat treating the inside radius is machined. The machining of the inside radius accomplishes several desirable aspects. The surface of the inside radius following application of the restrike die will, in most cases, exhibit anomalies such as small folds and other irregularities. The machining removes sufficient material from the surface to provide a smooth uniform finish. The term smooth uniform finish is used to designate a surface having no substantial discontinuities which would act as points of stress concentration. In addition the machining of the inside radius provides a slight increase in the final radius. It is desirable that the amount removed in the machining operation is restricted to that amount which is sufficient to minimize or eliminate any surface anomalies which might otherwise cause high stress. It is also desirable that there be only a small amount of material removed so as to limit any increase in the stress at the ends of the machined surface. Desirably the amount of material removed is such that the machining operation should not intrude further than 1.3% of the original bar thickness into the shank nor more than 2% of the original bar thickness into the blade. It is believed that within these limits it is possible to remove all surface anomalies remaining after application of the restrike die.

Figure 2B:
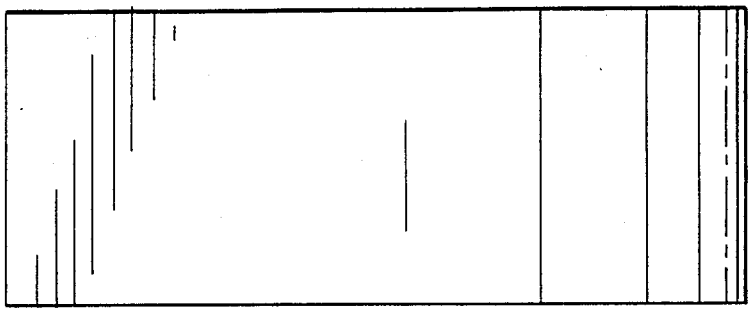
FIGS. 2A and 2B show a restrike die, in side and end view respectively.
Figure 2A:
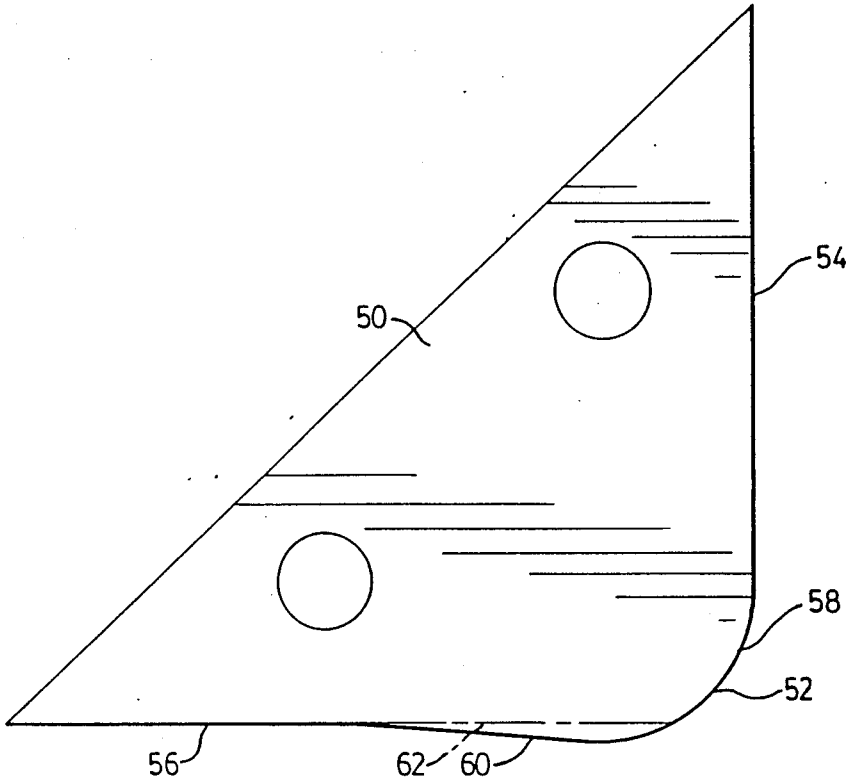

FIGS. 2A and 2B illustrate the restrike die. The restrike die 50 comprises a striking surface having several different portions. The striking surface 52 comprises a first relatively flat portion 54 which contacts the shank at the limit of travel of the restrike die. There is also a relatively flat portion 56 which contacts the blade at the limit of travel of the restrike die. Intermediate the two relatively flat portions of the striking surface there is a first substantially radially curved portion 58 and an off-set portion 60. The substantially radially curved surface 58 comprises and defines the inside radius of the heel after striking. The dotted line 62 is an extension of the flat surface 56 and is placed in FIGS. 2A and 2B to illustrate the amount of off-set surface 60. The off-set portion 60 extends deeper into the heel than the surface 56 and is utilized to create the clearance cavity 35 in the finished fork in conjunction with the operation of the backing die.

Figure 3:
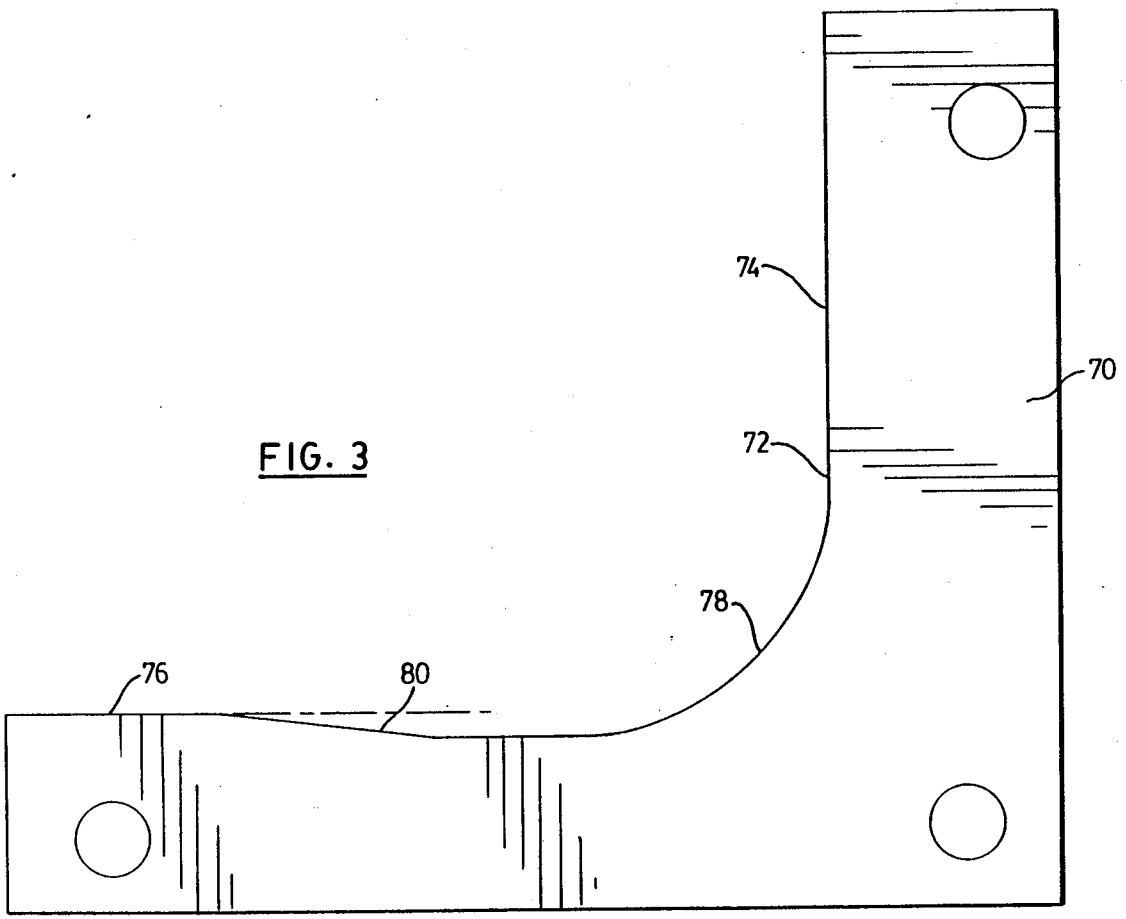
FIG. 3 is a side view of the backing die.

The backing die is illustrated in FIG. 3. The backing die 70 comprises a striking surface 72 for supporting the fork during the upset and striking steps. The striking surface 72 comprises a relatively flat surface 74 which contacts the shank during the forming operations and a relatively flat surface 76 which contacts the blade during the forming operations. Intermediate to the two relatively flat surfaces is a segment of a radial curved surface 78 and a tangential tapering surface 80. The segment of a radial curve supports and determines the outside radius of the finished fork. The tangential tapering surface has a dual function. The relief provided by the tangential tapering surface below the dotted line which illustrates an extension of the flat surface 76 ensures that during the upset and restrike steps the fork in the heel portion will be displaced slightly from the plane of the blade. The displacement from the dotted line to the solid line encourages both the thickening of the heel in the blade heel portion and also encourages the formation of the clearance cavity at the inside surface of the fork. The configuration of the backing die also, of course, determines the location of the heel taper.

From review of these figures and the above noted explanation it will be apparent that utilization of such dies produces a fork with the aforementioned desirable characteristics namely a thickening of the fork in the heel region adjacent both the shank and the blade while providing a clearance cavity, and a heel taper. The inside radius is substantially formed by the dies with final size determined in the machining operation.

In testing, a fork manufactured in the traditional bend and upset process and having an inside radius of 0.75" when subjected to a 2,500 pound loading exhibited a maximum heel tensile stress of 59,490 psi. An improved fork manufactured in accordance with this invention from the same basic stock material and having an inside radius of 1" after machining when subjected to the same 2,500 pound load exhibited a maximum heel tensile stress of only 47,970 psi. This indicates a reduction in stress in excess of 11,000 psi. This in turn means that the fork can have a substantially higher rated load or alternatively that a fork having the same rated load could be manufactured from smaller stock material. In either case the economic advantages of the improved fork and method of manufacture are clearly illustrated by the lessened stresses illustrated in this example. This improved fork had a ratio of blade heel thickness to blade thickness of 1.042 and a shank heel thickness to shank thickness ratio of 1.05.

I claim:

1. A fork capable of manufacture by the bend and upset process for a fork lift vehicle comprising a shank, a blade and a heel, said fork having a thickened portion where said heel meets said shank, and a thickened portion where said heel meets said blade, said blade having upper and lower surfaces, said shank having inner and outer surfaces, said heel of said fork having an inside radius extending into said upper surface to define a clearance cavity in said upper surface of said blade where said blade meets said heel, and said outer surface of said shank being generally planar and defining the outermost surface of said fork.

2. The fork of claim 1, said fork having a blade heel thickness to blade thickness ratio of at least 1.04 and a shank heel thickness to shank thickness ratio of at least 1.02.

3. The fork of claim 2 wherein said blade heel thickness to blade thickness ratio is at least 1.06 and the shank heel thickness to shank thickness ratio is at least 1.025.

4. The fork of claim 2, said fork having a machined inside radius.

5. The fork of claim 4, said fork having a transition portion between said blade and said heel comprising a tapered portion increasing in blade thickness toward said heel.

6. The fork of claim 4, said fork having an inside radius of approximately 1 inch.

* * * * *